US009038286B2

(12) United States Patent
Rucker

(10) Patent No.: US 9,038,286 B2
(45) Date of Patent: May 26, 2015

(54) FOOTWEAR ACCESSORY

(71) Applicant: Stephanie Rucker, Thousand Oaks, CA (US)

(72) Inventor: Stephanie Rucker, Thousand Oaks, CA (US)

( * ) Notice: Subject to any disclaimer, the term of this patent is extended or adjusted under 35 U.S.C. 154(b) by 333 days.

(21) Appl. No.: 13/625,858

(22) Filed: Sep. 24, 2012

(65) Prior Publication Data

US 2014/0082974 A1 Mar. 27, 2014

(51) Int. Cl.

| | |
|---|---|
| ***A43B 3/16*** | (2006.01) |
| ***A43B 1/00*** | (2006.01) |
| ***A43B 3/24*** | (2006.01) |
| ***A43B 13/26*** | (2006.01) |
| ***A43C 15/00*** | (2006.01) |

(52) U.S. Cl.

CPC ..... *A43B 3/16* (2013.01); *A43B 1/0027* (2013.01); *A43B 3/242* (2013.01); *A43B 3/246* (2013.01); *A43B 13/26* (2013.01); *A43C 15/00* (2013.01)

(58) Field of Classification Search

CPC ..... A43B 3/16; A43B 3/18; A43B 3/20; A43B 3/24; A43B 3/242

USPC ..... 36/7.1 R, 7.2, 72 R, 77 R, 100

See application file for complete search history.

(56) References Cited

U.S. PATENT DOCUMENTS

| | | | | | |
|---|---|---|---|---|---|
| 1,265,983 | A | * | 5/1918 | Wolff | 36/7.2 |
| 2,013,700 | A | | 9/1935 | Savale | |
| 2,250,794 | A | * | 7/1941 | Finegan | 36/7.2 |
| 2,257,390 | A | * | 9/1941 | Maling | 36/7.2 |
| 2,447,284 | A | * | 8/1948 | Bolte et al. | 36/7.2 |
| 2,465,911 | A | * | 3/1949 | Morgan | 36/72 R |
| 2,686,376 | A | * | 8/1954 | Burkholz | 36/9 R |
| 2,901,842 | A | | 9/1959 | De Lucia | |
| 3,034,231 | A | * | 5/1962 | Schwartz | 36/7.2 |
| 3,141,247 | A | * | 7/1964 | Mackay | 36/7.1 R |
| 3,221,421 | A | | 12/1965 | Leibmann et al. | |
| 3,304,629 | A | * | 2/1967 | Meyers | 36/7.2 |
| 3,373,510 | A | * | 3/1968 | Memole et al. | 36/100 |
| 4,616,428 | A | * | 10/1986 | Leger | 36/7.1 R |
| 4,850,122 | A | * | 7/1989 | Schwab, Jr. | 36/72 R |
| D341,475 | S | | 11/1993 | Ikezawa | |
| 5,311,676 | A | * | 5/1994 | Hughes et al. | 36/100 |
| 5,381,610 | A | * | 1/1995 | Hanson | 36/100 |
| D362,538 | S | | 9/1995 | Ikezawa | |
| 5,974,697 | A | * | 11/1999 | Tseng | 36/77 R |
| 6,029,373 | A | * | 2/2000 | Diradour et al. | 36/12 |
| D564,188 | S | | 3/2008 | Woodbury | |
| 8,015,731 | B2 | | 9/2011 | Jackson | |
| 8,316,563 | B2 | * | 11/2012 | Wegner | 36/100 |
| 2001/0007179 | A1 | * | 7/2001 | Mitchell | 36/77 R |
| 2003/0177664 | A1 | | 9/2003 | Monassebian | |
| 2008/0229615 | A1 | * | 9/2008 | Yu | 36/100 |
| 2008/0235993 | A1 | | 10/2008 | Wegner | |
| 2009/0126223 | A1 | * | 5/2009 | Metzger | 36/7.1 R |

* cited by examiner

*Primary Examiner* — Marie Bays

(74) *Attorney, Agent, or Firm* — Law Office of Elizabeth Swanson; Elizabeth Swanson

(57) ABSTRACT

A footwear accessory comprising a reversible footwear cover, the cover adapted to cover an article of footwear's uppers, sole and heel counter; a two sided sole attached to the cover, the sole adapted to provide both a frictional surface between the footwear and the cover and between a walking surface and the footwear; and, a cover retainer for securing the footwear cover to the footwear, the retainer being integral to the cover and adapted to be inserted into the footwear and positioned between a user's foot and the footwear.

14 Claims, 4 Drawing Sheets

FOOTWEAR ACCESSORY

CROSS REFERENCES TO RELATED APPLICATIONS

This application claims priority from provisional application No. 61/538,651 filed Sep. 23, 2011 and incorporates this provisional application's contents by reference herein.

FIELD OF INVENTION

The field of invention comprises footwear covers, namely covers for shoes and boots.

BACKGROUND

Conventional footwear surfaces easily get dirty or scratched. Conventional footwear users often get tired of polishing and cleaning their footwear and of using and wearing the same footwear over and over, and would prefer having a collection of various footwear styles and colors. However, buying a wide variety of footwear can get very expensive. There is a long felt need for an inexpensive way to appear as having a variety of footwear while in fact not having more than a few pair.

SUMMARY

The present invention includes a footwear accessory for footwear such as shoes or boots, comprising a cover or sheath material having a first and a second surface. Each surface may be constructed so that the cover is fully reversible. The cover or sheath is adapted to cover the footwear's uppers and heel counter. There is a sheath retaining collar for securing the footwear accessory, the retaining collar being integral to the sheath and adapted to be inserted into the footwear and frictionally retained between a user's foot and the footwear while the user is wearing the covered footwear.

The sheath defines a heel opening adapted to permit a heel of an article of footwear to extend beyond the two surfaces of the covering sheath. This sheath defines a foot opening through which the wearer of a covered article of footwear may insert a foot. Additionally, the foot opening is adapted to permit passage of an article of footwear therethrough into the cover. The foot opening has a toe section, an instep section and a heel section.

The first sole and the second sole are adapted to provide a non-slip surface that, depending upon the sole's placement either contacting the footwear's sole or contacting to a walking surface, reduces the likelihood that covering the footwear will perceptibly increase the chance of user slippage while the cover or sheath is in use.

The cover disclosed herein also provides a footwear covering that is adapted to have an elongated leg-covering portion that gives a covered shoe wearer the appearance of a boot wearer. This shoe-to-boot-cover comprises a sheath adapted to cover a shoe or short boot including the uppers, sole and heel counter. The sheath defines a heel opening and a leg opening and has a first and a second sole that function to reduce slippage.

The cover disclosed herein also provides a boot covering having a first and second surface that covers the uppers, sole and heel counter of a boot. This boot cover comprises a sheath adapted to cover the boot's uppers, sole and heel counter. The boot cover comprises two soles, one mounted on each of the covering's two surfaces. The boot cover has a sheath retaining collar extending from a foot opening defined by the sheath and a heel opening adapted to permit the covered boot's heel to extent past both surfaces of the sheath and to not be covered by the sheath.

In lieu of two soles on two surfaces, this disclosure also includes a double sided sole. Such double sided sole may be made by applying a liquid compound which seeps through both surfaces of the cover and so provides two soles. It may also comprise any other result of manufacture that results in each of the two surfaces of the sheath comprising a functional sole.

The above description sets forth, rather broadly, a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims.

DETAILED DESCRIPTION

In the following detailed description of the preferred embodiments, reference is made to the accompanying drawings, which form a part of this application. The drawings show, by way of illustration, certain embodiments and versions of embodiments in which the invention may be practiced. It is to be understood that other embodiments may be used and structural changes may be made without departing from the scope of the present invention. Also, it is to be understood that the phraseology and terminology employed herein are for the purpose of description and should not be regarded as limiting.

The present invention includes various embodiments of a footwear cover that changes the style of a user's footwear.

FIGS. 1-5 depict a footwear cover 10 of this disclosure and claims adapted to cover a heeled shoe. The footwear cover 10 may be made of sheathing materials known in the art, including but not limited to cotton, polyester, synthetic blends and leather. The polyester may include 4-way stretch or 6-way stretch material. The cover has two surfaces, namely a first surface 19 and a second surface 21.

The cover 10 may use various known materials that bear designs, patterns, colors, or ornaments for aesthetic purposes, including animal prints, colors or patterns. The cover 10 may be fully reversible having a first surface 19 and a second surface 21 of different materials, patterns, colors or ornaments. The cover 10 may be adapted to fit snugly to an article of footwear. The cover 10 may flexibly conform to the shape of an article of footwear.

Figure 1:
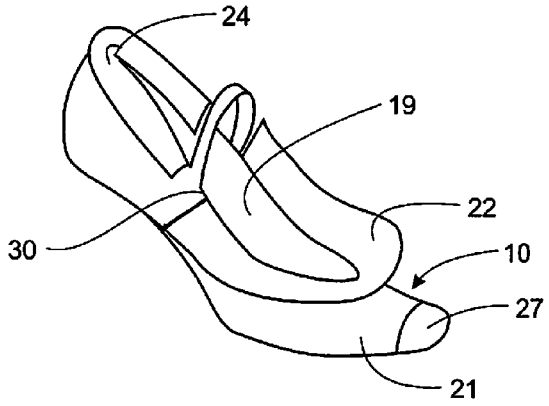
FIG. 1 is substantially a perspective view of the footwear cover of the disclosure adapted for a women's heeled footwear.
Figure 2:
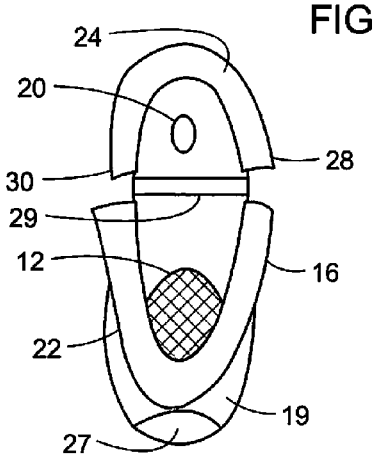
FIG. 2 is substantially a top plan view of one version of the cover of FIG. 1.
Figure 3:
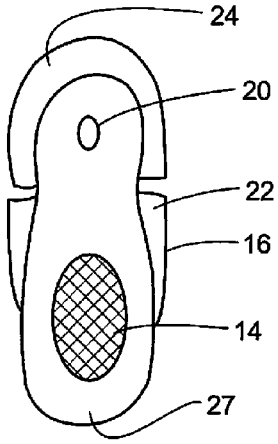
FIG. 3 is substantially a bottom plan view of the same version of the cover of FIG. 2.
Figure 4:
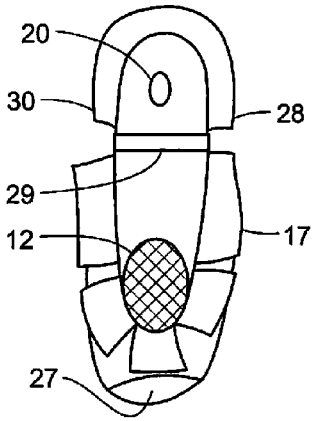
FIG. 4 is substantially a top plan view of a second version of the cover of FIG. 1.
Figure 5:
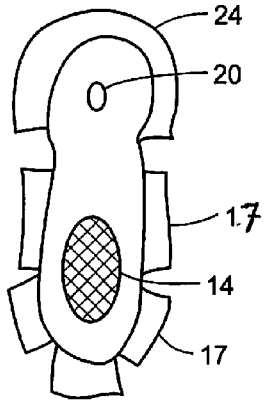
FIG. 5 is substantially bottom plan view of the same version of the cover of FIG. 4.

Referring now to FIG. 2, footwear cover 10 may include a first sole 12 on the first surface 19 of the cover 10, which first sole 12 in one embodiment is made of rubber, plastic or of any material which improves traction and friction between the covered sole of a shoe 23 and the first sole 12 of the cover 10. Referring now to FIG. 3, footwear cover 10 also includes a second sole 14 on the second surface of the cover 21, which in one embodiment is made of rubber, plastic or of any material which improves traction and friction between the second sole 14 and a walking surface (e.g., a sidewalk, cement, carpeting, etc.) when the user is using footwear 11 covered according to the disclosure herein. Additionally, as depicted in FIGS. 1-5, the cover may be fully reversible having one cover pattern on the first surface 19 of the cover and another cover pattern on the second surface 21 of the cover. Similarly, the sole 12 on the first surface 19 and the second sole 14 on the second surface 21 may each of them serve as a non-slip surface for contact with the sole of an article of covered footwear or for contact with a walking surface.

The footwear cover 10 preferably also includes a heel opening 20 adapted for allowing the heel of covered footwear 18 to extend through the footwear cover 10. By allowing the heel 18 to extend through the heel opening 20 of the flexible footwear cover 10, the footwear's own heel 18 is exposed. There is typically a friction pad on the bottom of the heel 18 which, since it is not covered, also prevents slippage. It can be realized that the heel opening 20 can be modified on embodiments designed to cover flat footwear. There may optionally be no heel opening.

Figure 6:
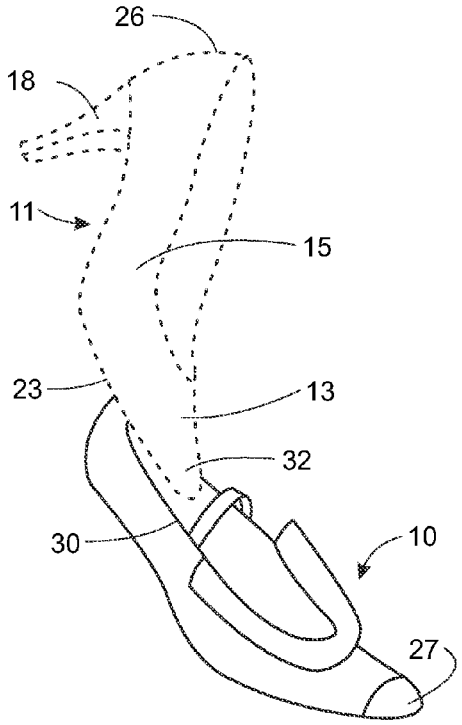
FIG. 6 is substantially a perspective view of an article of footwear being inserted into the cover of FIG. 1.
Figure 7:
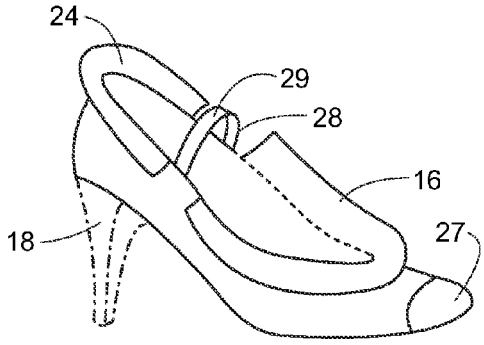
FIG. 7 is substantially a perspective view of the cover of FIG. 1 showing the retainer positioned within the footwear.

Referring now to FIG. 1, the footwear cover 10 may be of a sheath adapted to wrap around footwear 11. The footwear cover 10 may define a foot opening 30 to accommodate insertion of the user's foot 40 into the footwear 11. Alternatively, the foot opening 30 may be formed from the sheathing or footwear cover material, and it may be integral with a retainer 16. As depicted in FIG. 6, an article of footwear 11 may be inserted through the foot opening 30 into the footwear cover 10. The footwear cover 10 preferably snugly covers the toe box 13, uppers 15, and heel counter 26 of the footwear 11. The first sole 12 of the cover is adapted to be positioned substantially underneath the sole of the footwear 23. The heel 18 of the footwear protrudes out of the footwear cover 10 through the heel opening 20.

When the footwear 11 is inserted through the opening 30 of the footwear cover 10 and the footwear cover 10 is tucked into the toe box 13, the uppers 15 and heel counter 26 of the footwear 11, the footwear cover 10 can provide a snug fit. The first surface of the cover 19 lies under the user's footwear 11 and the second surface 21.

Figure 8:
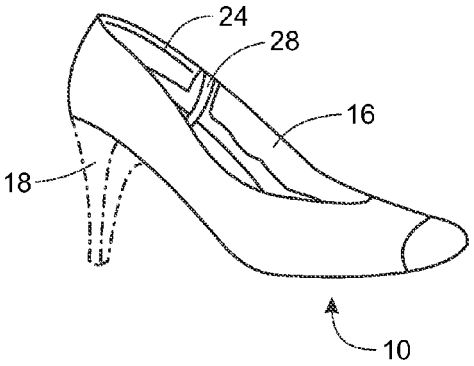
FIG. 8 is substantially a perspective view of the cover of FIG. 1 as it appears on an article of covered footwear.
Figure 9:
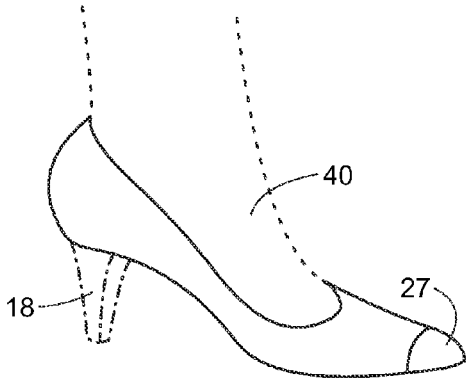
FIG. 9 is substantially a perspective view of a user wearing a covered article of footwear.

The retainer 16 preferably extends past the footwear uppers 15, toe box 13 and heel counter 26. As shown in FIG. 8, the retainer 16 can be inserted in the footwear 11. A user can then insert a foot 40 into the footwear 11, which would cause the footwear cover 10 to be secured to the footwear 11, as the user's foot 40 will press the footwear cover 10 against the footwear 11.

The retainer 16 may have a flexible front-retaining portion 22 and a flexible heel-retaining portion 24. The front-retaining portion may optionally be divided into segments 17 as show in FIGS. 4 and 5. There may also be a stirrup shaped retaining portion 28 positioned between the front retainer 22 and heel retainer 24. The stirrup shaped retaining portion 28 is attached in two positions to the foot opening 30 and has a mid-portion 29 which fits into the arch of a user's foot 40. The heel retaining portion 24 may comprise an elastic material.

The sheath 10 further comprises a toe guard 27 positioned on the first surface 19, the second surface 21 or both 19, 21. The toe guard 27 is adapted to prevent the toe of the footwear. It 27 may be positioned on one or both sheath surfaces 19, 21 or it 27 may be positioned between these surfaces 19, 21.

Figure 10:
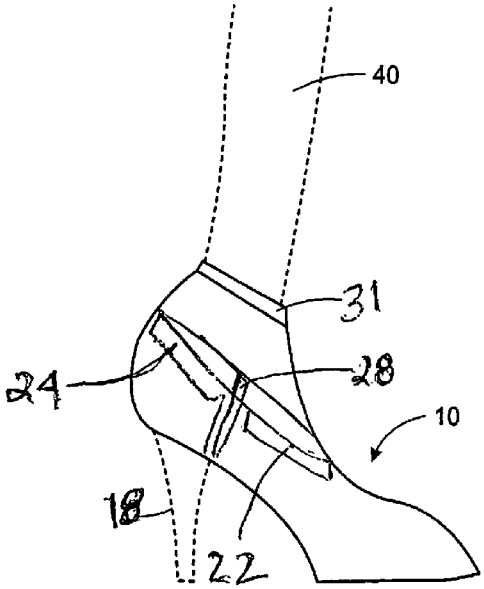
FIG. 10 is substantially a side view of a shoe worn by a user covered by a sheath of this disclosure which gives the appearance of the footwear user wearing ankle boots.
Figure 11:
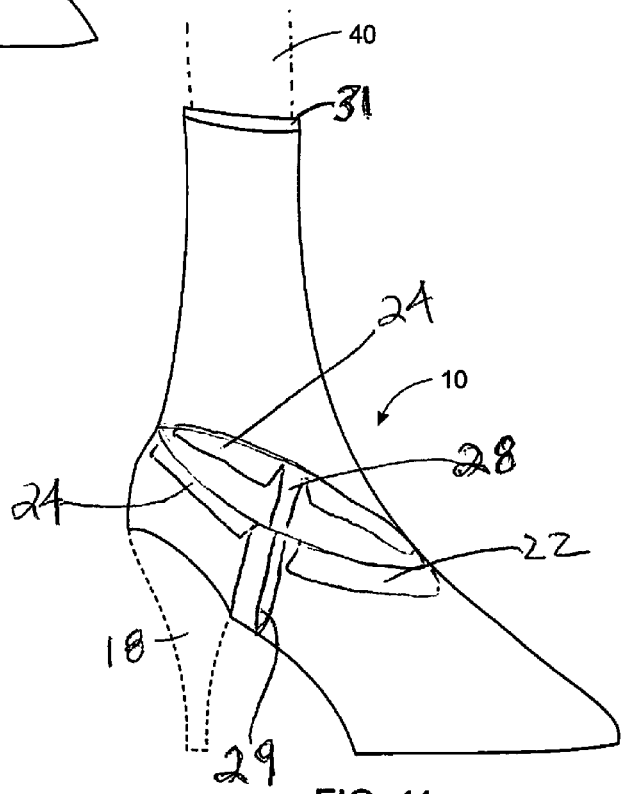
FIG. 11 is substantially a side view of an article of footwear worn by a user covered by a sheath of this disclosure which gives the appearance of the footwear user wearing mid-calf boots.

The sheath 10 may cover only a shoe or may be adapted to extend up a user's leg 40 to provide the appearance that the user is wearing an ankle boot, as in FIG. 10, or a mid-calf boot, FIG. 11. As provided in FIG. 10 and FIG. 11, an elastic band 31 may be attached to the top of the sheath 10 to elastically hold up the top of the sheath 10 on a user's leg 40 when the sheath is pulled up to the desired position. There is no limit to the length of a user's leg 40 being covered by the covering sheath of the disclosure.

Figure 12:
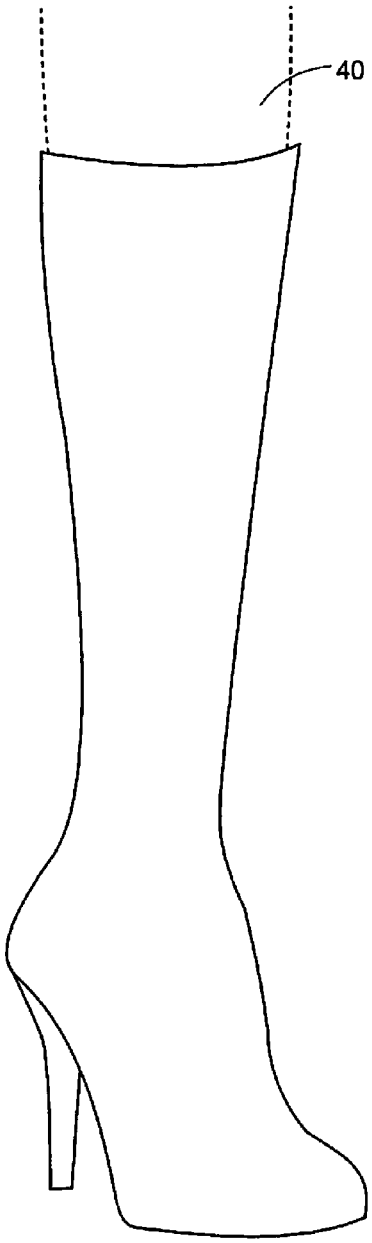
FIG. 12 is a front perspective of a heeled boot, not claimed by this disclosure.
Figure 13:
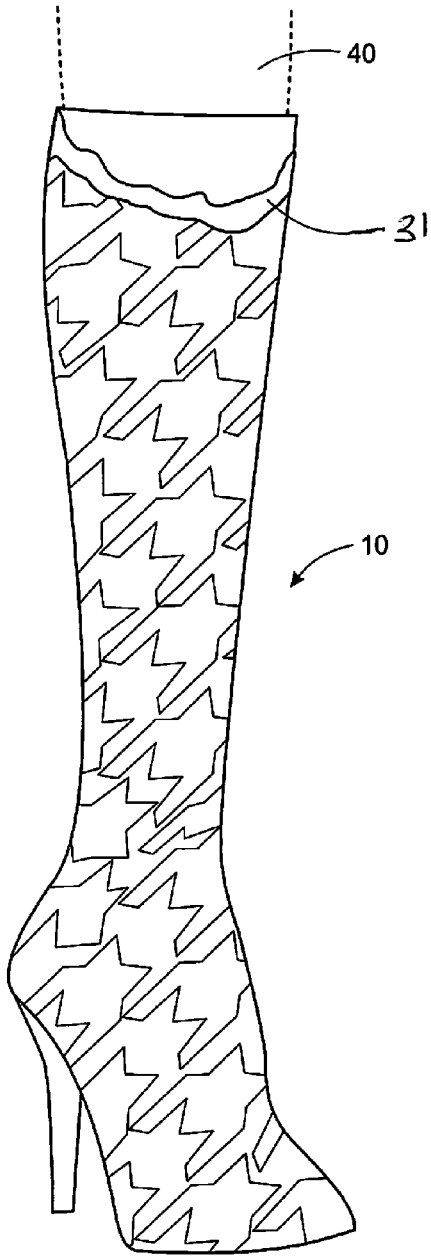
FIG. 13 is a front perspective of the heeled boot of FIG. 11 covered by a sheath of this disclosure.

The sheath 10 may cover a boot, providing a covered boot (FIG. 13) having the same overall height as an uncovered boot (FIG. 12). Alternatively, the sheath 10 may extend past the top of a boot to create the appearance of a taller boot.

It can now be realized that the various embodiments of the present invention provide ways for people to change the looks of their footwear as often as they wish without having to purchase a new pair of footwear. The various embodiments may further allow consumers to hold on to their existing footwear longer. They provide fashionable and convenient alternatives for people to change the look of their footwear. The present disclosure saves its users from having to carry multiple pairs of footwear when they expect to change their wardrobe on a given day.

Although the description above contains many specifications, these should not be construed as limiting the scope of the invention but as merely providing illustrations of some of the presently preferred embodiments of this invention. For example, the sheathing material used, the pattern or design of the footwear cover, the color of the footwear cover, and the presence or absence of the mid-sole and heel opening may be varied. The invention is capable of other embodiments and of being practiced and carried out in various ways. The invention is not limited in its application to the details of the construction and to the arrangement of the components set forth in the above description or as illustrated in the drawings.

What is claimed is:

1. A footwear covering sheath comprising:

a. A sheath comprising material having a first surface and a second surface, the sheath adapted to cover an article of footwear's uppers, sole and heel counter; and b. The sheath defining a heel opening adapted to permit a heel of an article of footwear to extend therethrough and defining a foot opening adapted to permit a foot of a user to be inserted therethrough into the footwear, the foot opening having a toe section, an instep section and a heel section;

c. The sheath having a first sole on the first surface and a second sole opposite the first sole on the second surface, the first sole adapted to improve traction between the sole of the covered footwear and the sheath when the cover is in place on the footwear, and the second sole is adapted to improve traction between the covered footwear and walking surfaces upon which the covered footwear is used by a user;

d. A sheath retaining collar extending from the foot opening and adapted to be positioned and to be frictionally retained between the user's foot and a first surface of a piece of footwear; the sheath retaining collar having a flexible front-retaining portion, a flexible heel-retaining portion and a flexible stirrup-shaped retaining portion, the stirrup-shaped portion having a first end, a second end and a middle section, the first end and the second end attached to opposite sides of the foot opening and the middle section adapted to frictionally engage with an instep of the user's foot when the foot is inserted through the foot opening and placed inside the covered footwear; and e. At least one toe guard attached to the first side of the sheath, the toe guard adapted to cover a toe portion of a piece of footwear.

2. The footwear covering sheath of claim 1, the sheath including a 4-way stretch fabric.

3. The footwear covering sheath of claim 1, the retainer including elastic.

4. The footwear covering sheath of claim 1, the sheath comprising both a first toe guard attached to the first surface of the sheath and a second toe guard attached to the second side of the sheath.

5. The footwear covering sheath of claim 1, the first surface comprising a first piece of material and the second surface comprising a second piece of material.

6. The footwear covering sheath of claim 1, the sheath comprising a toe guard positioned between the first surface and the second surface of the sheath.

7. A footwear covering sheath comprising:

a. a sheath comprising stretchable material defining a heel opening and a foot opening;

b. a double sided sole positioned and adapted to provide a first non-slip surface between a user's footwear and the sheath, and adapted to provide a second non-slip surface between a user's footwear and a walking surface;

c. a sheath retainer having a toe section, an instep section comprising a flexible stirrup-shaped retaining portion, and a heel section, which retainer frictionally maintains the cover when a user wears a covered article of footwear;

d. a heel opening;

e. a foot opening, the sheath retainer positioned about and attached to the foot opening; and f. a toe guard.

8. The footwear covering sheath of claim 7 comprising a double sided sole having identical surfaces.

9. The footwear covering sheath of claim 7 comprising a double sided sole having non-identical surfaces.

10. The footwear covering sheath of claim 7 comprising a first surface made from a first material and a second surface made from a second material, the first and second materials being equally adapted to be worn on the surface facing away from the footwear.

11. A footwear cover comprising:

a. a foot section and a leg section, the foot section and leg sections having a first surface and a second surface;

b. the foot section defining a heel opening adapted to permit the heel of an article of footwear to extend therethrough and defining a foot opening adapted to permit the foot of a user to extend therethrough and defining a foot opening adapted to permit the foot of a user to extend through the foot opening;

c. a sheath retaining collar extending from the foot opening and adapted to be positioned and to be frictionally retained between the user's foot and a first surface of a piece of footwear, the sheath retaining collar having a flexible front-retaining portion, a flexible heel-retaining portion and a flexible stirrup-shaped retaining portion, the stirrup-shaped portion having a first end, a second end and a middle section, the first end and the second end attached to opposite sides of the foot opening and the middle section adapted to frictionally engage with an instep of the user's foot when the foot is inserted through the foot opening and placed inside the covered footwear; and d. the foot section having soles on opposing sides, each sole adapted to provide a non-slip surface between the sole and the sole of an article of footwear and the sole and a walking surface.

12. The footwear cover according to claim 11 comprising a foot opening adapted to permit an article of footwear to be inserted therethrough into the cover.

13. The footwear cover according to claim 11 comprising a sheath adapted to extend past the covered footwear and to cover a section of a user's leg that is not covered by the footwear.

14. The footwear cover according to claim 11 comprising a sheath adapted to cover a boot.

* * * * *